US008533987B2

(12) United States Patent
Rogers et al.

(10) Patent No.: US 8,533,987 B2
(45) Date of Patent: Sep. 17, 2013

(54) MAGAZINE WELL GRIP

(75) Inventors: William H. Rogers, St. Augustine, FL (US); Matthew E. McKendrick, Jacksonville, FL (US)

(73) Assignee: Prezine, LLC, Jacksonville, FL (US)

( * ) Notice: Subject to any disclaimer, the term of this patent is extended or adjusted under 35 U.S.C. 154(b) by 373 days.

(21) Appl. No.: 13/006,781

(22) Filed: Jan. 14, 2011

(65) Prior Publication Data

US 2012/0167431 A1 Jul. 5, 2012

Related U.S. Application Data

(60) Provisional application No. 61/295,015, filed on Jan. 14, 2010.

(51) Int. Cl.
*F41C 23/00* (2006.01)

(52) U.S. Cl.
USPC ..... 42/72; 42/85

(58) Field of Classification Search
USPC ..... 42/7, 72, 85
See application file for complete search history.

(56) References Cited

U.S. PATENT DOCUMENTS

| | | | | |
|---|---|---|---|---|
| 5,621,997 | A * | 4/1997 | Pearce | 42/71.02 |
| 6,112,446 | A * | 9/2000 | Forster et al. | 42/71.02 |
| 7,467,489 | B2 * | 12/2008 | Gussalli Beretta | 42/72 |
| 7,937,874 | B2 * | 5/2011 | Roth | 42/72 |
| 2011/0185617 | A1 * | 8/2011 | Brixius | 42/71.01 |

* cited by examiner

*Primary Examiner* — J. Woodrow Eldred

(57) ABSTRACT

A magazine well grip includes a generally U-shaped body having an outer surface, with a plurality of finger grooves defined therein, and an inner surface. An upper section of the inner surface is contoured to closely accommodate a magazine well of a firearm, the upper section terminating at a lip recess dimensioned to accommodate a lower lip of the magazine well in an interference fit arrangement. A lower section of the inner surface flares outwardly from below the lip recess. The generally U-shaped body includes a pair of spaced-apart, generally opposed sidewalls and a front wall. A generally wedge-shaped protrusion extends upwardly from the front wall of the body and is dimensioned for an interference fit between trunnions on a forward edge of the magazine well and behind a hinge portion of an upper receiver when arranged between the trunnions.

20 Claims, 3 Drawing Sheets

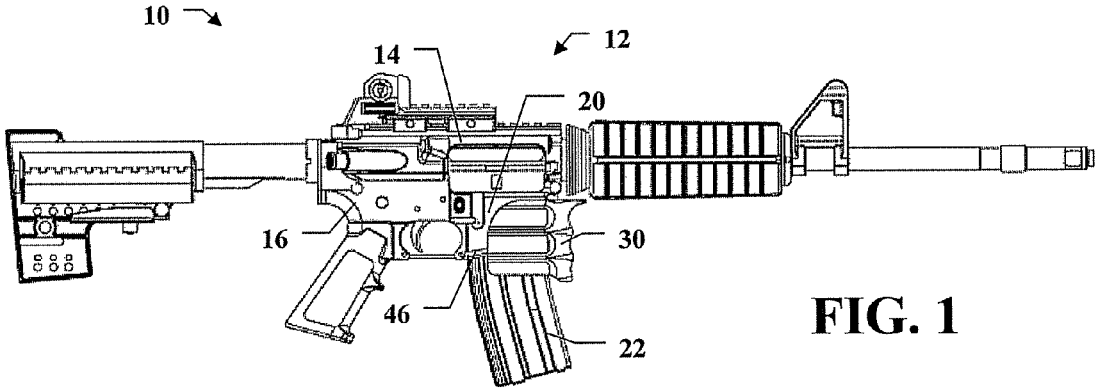
FIG. 1
FIG. 2
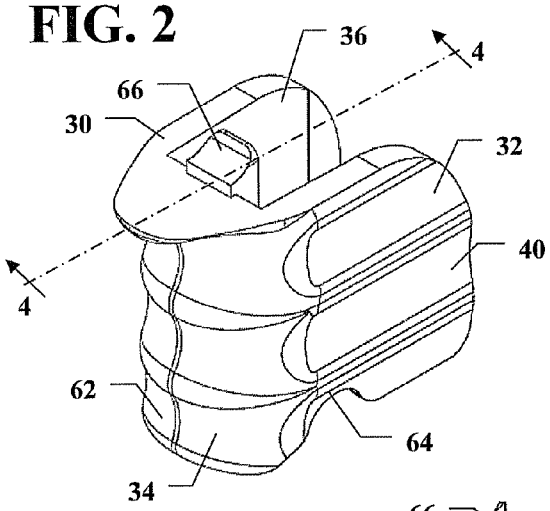
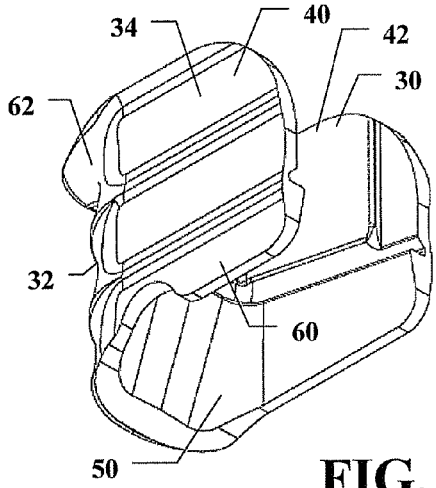
FIG. 3
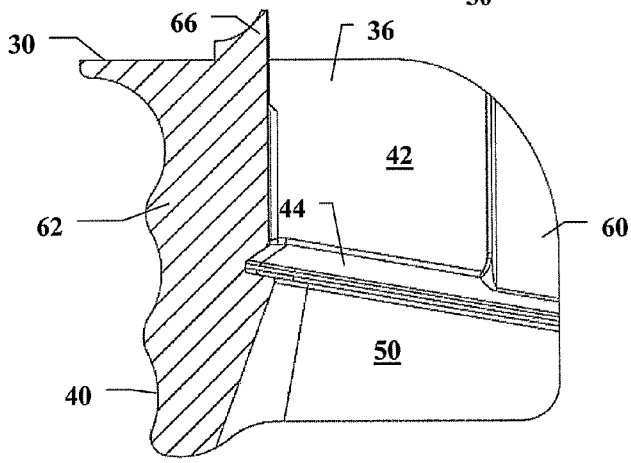
FIG. 4

MAGAZINE WELL GRIP

CROSS-REFERENCE TO RELATED APPLICATION

This application claims the benefit of U.S. Provisional Application Ser. No. 61/295,015, filed on Jan. 14, 2010, the contents of which are herein incorporated by reference in their entirety.

FIELD OF THE INVENTION

The present invention relates to grips for firearms, and more particularly, to fore grips for assault rifles having magazine wells.

BACKGROUND OF THE INVENTION

Assault rifle users are known to use the magazine well area of the receiver as a grip for the non-shooting hand, both while firing and carrying the rifle. In general, the magazine well area is not designed to accommodate a hand, having uncomfortable contours, including sharp edges. As a result, discomfort is experienced after prolonged contact.

SUMMARY OF THE INVENTION

Based on the foregoing, it is an object of the present invention to provide an improved magazine well grip. According to an embodiment of the present invention, a magazine well grip includes a generally U-shaped body with an outer surface and an inner surface. The outer surface is generally contoured to comfortably accommodate the non-shooting hand of a user and the inner surface is generally contoured to closely accommodate a magazine well.

According to an aspect of the present invention, the inner surface includes a lip recess dimensioned to accommodate a lower lip of the magazine well in an interference fit arrangement. According to a further aspect of the present invention, a lower section of the inner surface flares outwardly to facilitate insertion of a magazine into the magazine well. According to an additional aspect of the present invention, a protrusion extending upwardly from a front wall of the magazine well grip is dimensioned to be closely accommodated between trunnions extending from a forward face of the magazine well.

These and other objects, aspects and advantages of the present invention will be better appreciated in view of the drawings and following detailed description of a preferred embodiment.

BRIEF DESCRIPTION OF THE DRAWINGS

FIG. 1 is a side view of a rifle including a magazine well grip, according to an embodiment of the present invention;

FIG. 2 is a perspective view of the magazine well grip of FIG. 1;

FIG. 3 is another perspective view of the magazine well grip of FIG. 1;

FIG. 4 is a sectional view taken along line 4-4 of FIG. 3;

DETAILED DESCRIPTION OF A PREFERRED EMBODIMENT

Figure 5:
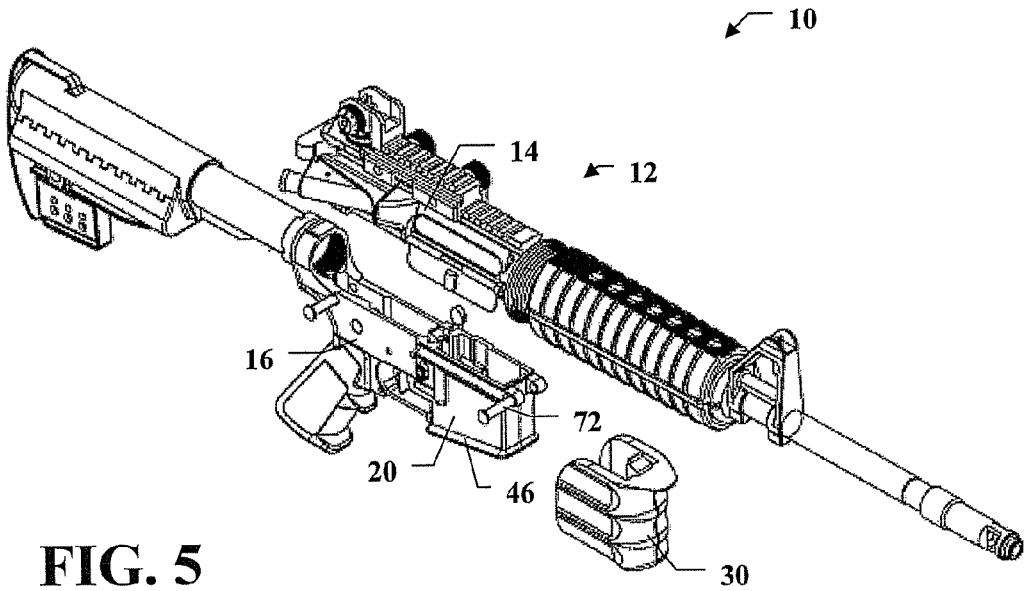
FIG. 5 is a perspective view of the rifle and magazine well grip of FIG. 1, in a disassembled configuration.

Referring to FIG. 1, an assault rifle 10 includes a receiver assembly 12 having an upper receiver portion 14 and a lower receiver portion 16. The lower receiver portion 16 includes a magazine well 20 releasably accommodating a magazine 22. According to an embodiment of the present invention, a magazine well grip 30 is releasably fitted about the magazine well 20. Advantageously, the grip 30 is formed as an integral, one-piece unit, preferably composed of a molded polymer material.

Referring to FIGS. 2-4, the grip 30 has a generally U-shaped body 32 with an outer surface 34 and an inner surface 36. The outer surface 34 is generally contoured to comfortably accommodate the non-shooting hand of a user, and defines one or more finger grooves 40.

An upper section 42 of the inner surface 36 is generally contoured to closely accommodate the magazine well 20 and terminates in a lip recess 44. The lip recess 44 is dimensioned to accommodate a lower lip 46 of the magazine well 20 in an interference fit arrangement.

A lower section 50 of the inner surface 36 flares outwardly to assist in proper loading of the magazine 22 into the magazine well 20. The lower section 50 effectively forms a funnel to guide the magazine 22 during insertion. This is particularly advantageous for magazine loading in the dark or when the user must remain focused on a target.

The U-shaped body 32 is formed with generally opposed sidewalls 60 and a front wall 62. A doubler notch 64 is defined in a lower edge of one of the sidewalls 60 to prevent interference between the grip 30 and a magazine doubler (not shown). An exemplary magazine doubler can be seen in U.S. Pat. No. 7,497,043, the contents of which are herein incorporated by reference. A generally wedge-shaped protrusion 66 extends upwardly from the front wall.

Referring to FIG. 5, to secure the magazine well grip 30 to the magazine well 20, the upper and lower receiver portions 14, 16 are unpinned and detached. The grip 30 is then slid onto to the magazine well 20 from the front, with the lip recess 44 (see FIG. 3) aligned with the lip 46 to achieve an interference fit.

Figure 6:
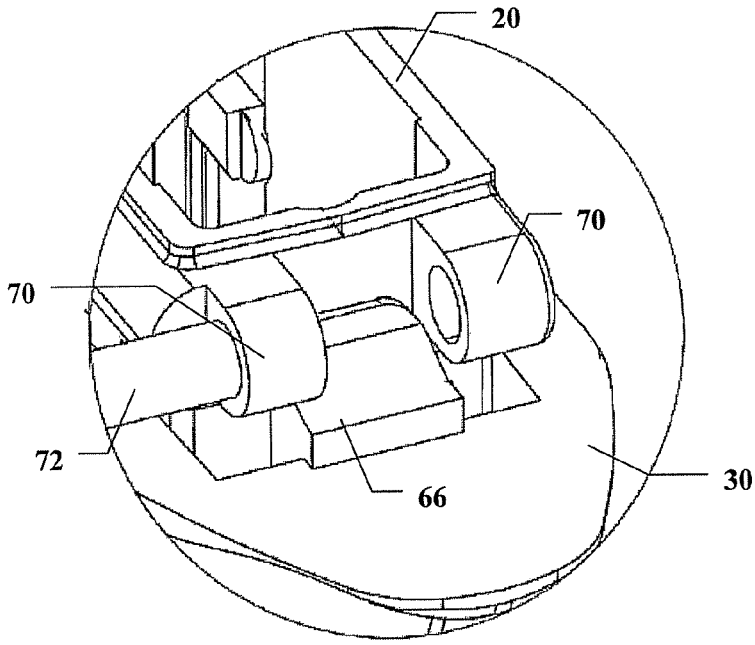
FIG. 6 is a detail view of portions of the rifle and magazine well grip of FIG. 1, in a partially assembled configuration.
Figure 7:
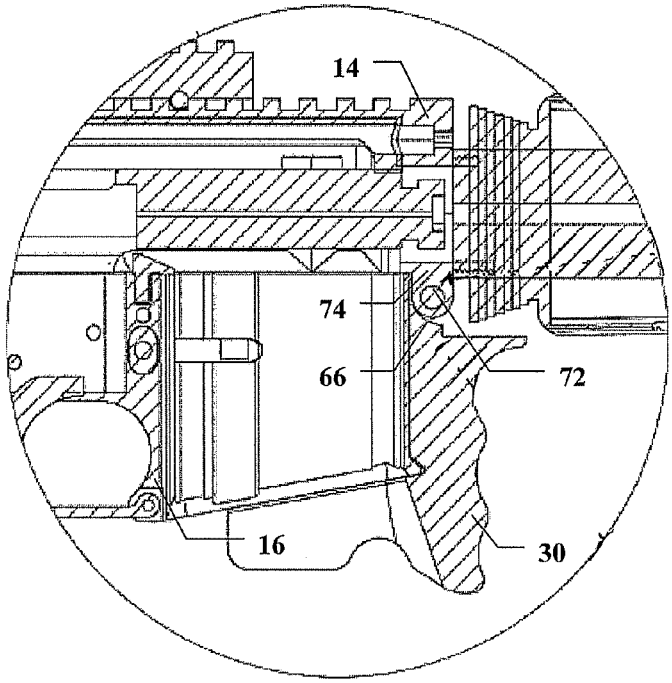
FIG. 7 is a detail sectional view of portions of the rifle and magazine well grip of FIG. 1.

Referring to FIG. 6, trunnions 70 are arranged on the forward face of the magazine well 20, which accommodate a pin 72 therethrough, for engaging a complementary bore in a hinge portion 74 of the upper receiver 14 (see FIG. 7). Once the grip 30 has been slid all the way onto the magazine well 20, the protrusion 66 will extend between the trunnions 70, achieving a slight interference fit and inhibiting lateral motion of the grip 30.

Figure 8:
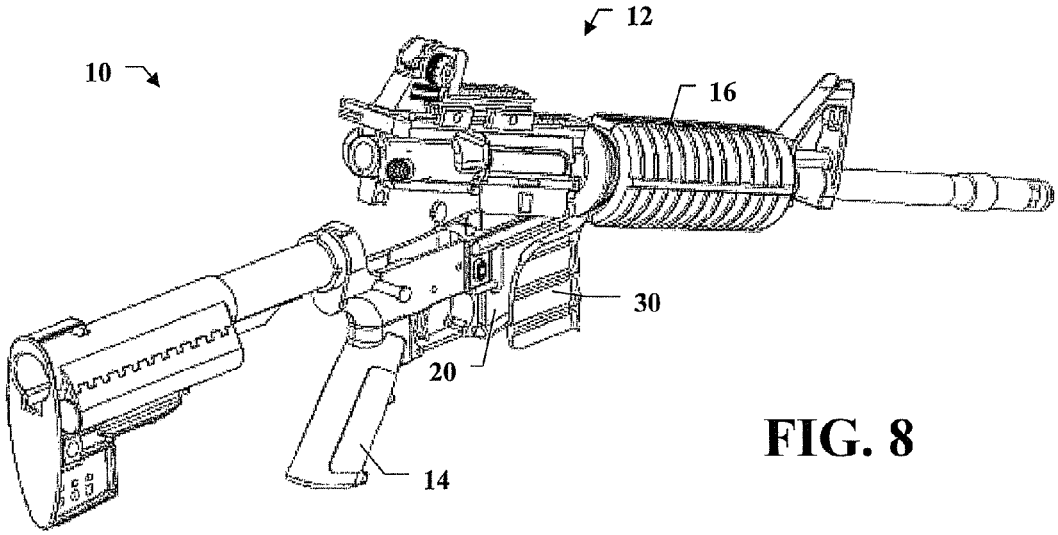
FIG. 8 is a perspective view of the rifle and magazine well grip of FIG. 1, with the rifle partially broken down for servicing.

Referring to FIG. 7, when the upper receiver portion 14 is re-attached and re-pinned, the hinge portion 74 of the upper receiver 14 is located in front of the protrusion 66, inhibiting forward movement, and subsequent removal, of the grip 30. Forward of the protrusion 66, clearance between the grip 30 and the upper receiver potion 72 is sufficient to allow pivoting of the upper receiver portion 16 relative to the lower receiver potion 14 about the pin 72 without removal of the grip 30. Referring to FIG. 8, the upper receiver portion 16 is in the pivoted position with the grip 30 attached, for instance, to facilitate inspection, cleaning or other servicing.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described, and of the appended claims.

What is claimed is:

1. A magazine well grip comprising:

a generally U-shaped body having an outer surface and an inner surface, an upper section of the inner surface being generally contoured to closely accommodate a magazine well of a firearm, the upper section terminating at a lip recess dimensioned to accommodate a lower lip of the magazine well in an interference fit arrangement, and a lower section of the inner surface flaring outwardly from below the lip recess.

2. The grip of claim 1, wherein the generally U-shaped body includes a pair of spaced-apart, generally opposed sidewalls and a front wall.

3. The grip of claim 2, further comprising a protrusion extending upwardly from the front wall and dimensioned to fit between trunnions on a forward edge of the magazine well and behind a hinge portion of an upper receiver when arranged between the trunnions.

4. The grip of claim 3, wherein the protrusion is dimensioned for an interference fit between the trunnions.

5. The grip of claim 3, wherein the protrusion is generally wedge-shaped, and forward of the protrusion, the body is dimensioned to allow sufficient clearance relative to the upper receiver to allow pivoting thereof using the hinge portion.

6. The grip of claim 2, wherein a notch is defined in a lower edge of one of the pair of sidewalls and dimensioned to allow accommodation of a magazine doubler.

7. The grip of claim 1, wherein a plurality of finger grooves are defined in the outer surface of the body.

8. The grip of claim 1, wherein the grip is integrally molded from a polymer material.

9. The grip of claim 1, wherein the generally U-shaped body includes a pair of spaced-apart, generally opposed sidewalls and a front wall, a protrusion extending upwardly from the front wall and dimensioned to fit between trunnions on a forward edge of the magazine well and behind a hinge portion of an upper receiver when arranged between the trunnions, the protrusion being dimensioned for an interference fit between the trunnions, the protrusion being generally wedge-shaped, and forward of the protrusion, the body is dimensioned to allow sufficient clearance relative to the upper receiver to allow pivoting thereof using the hinge portion, a notch being defined in a lower edge of one of the pair of sidewalls and dimensioned to allow accommodation of a magazine doubler, and a plurality of finger grooves being defined in the outer surface of the body.

10. A magazine well grip comprising:

a generally U-shaped body having an outer surface, with a plurality of finger grooves defined therein, and an inner surface, an upper section of the inner surface being generally contoured to closely accommodate a magazine well of a firearm, the upper section terminating at a lip recess dimensioned to accommodate a lower lip of the magazine well in an interference fit arrangement, a lower section of the inner surface flaring outwardly from below the lip recess, and the generally U-shaped body including a pair of spaced-apart, generally opposed sidewalls and a front wall; and a generally wedge-shaped protrusion extending upwardly from the front wall of the body and dimensioned for an interference fit between trunnions on a forward edge of the magazine well and behind a hinge portion of an upper receiver when arranged between the trunnions.

11. The grip of claim 10, wherein a notch is defined in a lower edge of one of the pair of sidewalls and dimensioned to allow accommodation of a magazine doubler.

12. The grip of claim 10, wherein, forward of the generally wedge-shaped protrusion, the body is dimensioned to allow sufficient clearance relative to the upper receiver to allow pivoting thereof using the hinge portion.

13. The grip of claim 10, wherein the grip is integrally molded from a polymer material.

14. A method of installing a magazine well grip on a firearm comprising:

orienting a generally U-shaped body of the grip such that an open rearward end of the U-shaped body faces a forward surface of the magazine well; and sliding the body rearwardly over the magazine well so as to closely accommodate the magazine well therein, at least a portion of the inner surface of the body engaging a corresponding portion of the magazine well and being the sole support of the body on the magazine well in an interference fit.

15. The method of claim 14, wherein sliding the body rearwardly over the magazine well includes engaging a lower lip of the magazine well in a lip recess defined in the inner surface of the body.

16. The method of claim 14, wherein sliding the body rearwardly over the magazine well includes positioning an outwardly flaring lower section of the inner surface below the magazine well so as to facilitate the loading of magazines therein.

17. The method of claim 14, further comprising, prior to sliding the body rearwardly over the magazine well, removing an upper receiver of the firearm from a lower receiver portion thereof by unpinning a hinge portion of the upper receiver from between trunnions of the lower receiver portion located on a forward face of the magazine well.

18. The method of claim 17, wherein sliding the body rearwardly over the magazine well includes disposing a generally wedge-shaped protrusion extending upwardly from the body between the trunnions.

19. The method of claim 18, further comprising, after sliding the body rearwardly over the magazine well, replacing the upper receiver portion and repinning the hinge portion between the trunnions, such that subsequent forward sliding of the body is inhibited by engagement of the generally wedge-shaped protrusion with the hinge portion.

20. The method of claim 14, wherein sliding the body rearwardly over the magazine well includes positioning an upper surface of the forward end of the body below an upper receiver of the firearm with sufficient clearance to allow pivoting of the upper receiver relative to the lower receiver for cleaning and inspection without removing the grip.

* * * * *